US005546928A

United States Patent [19]

Lewis et al.

[11] Patent Number: 5,546,928

[45] Date of Patent: Aug. 20, 1996

[54] GREASE SPLATTER GUARD

[76] Inventors: Dan Lewis, 1007 S. Edwards Rd.; Anthony Lewis, 8001 E. Gloucester Rd. both of, Muncie, Ind. 47302

[21] Appl. No.: 442,772

[22] Filed: May 17, 1995

[51] Int. Cl.[6] ..... F24C 15/10

[52] U.S. Cl. ..... 126/214 D; 126/42; 126/211

[58] Field of Search ..... 126/211, 42, 299 C, 126/214 D, 201, 214 R

[56] References Cited

U.S. PATENT DOCUMENTS

| | | | |
|---|---|---|---|
| 2,778,356 | 1/1957 | Pugach . | |
| 3,043,289 | 7/1962 | Fox | 126/42 |
| 3,513,826 | 5/1970 | Hellmuth . | |
| 4,155,343 | 5/1979 | Hartman . | |
| 4,157,705 | 6/1979 | Caan . | |
| 4,517,955 | 5/1985 | Ehrlich et al. . | |
| 4,836,181 | 6/1989 | Saga . | |
| 5,076,255 | 12/1991 | Harrison . | |
| 5,117,807 | 6/1992 | Granlich | 126/221 X |
| 5,357,942 | 10/1994 | Williams et al. | 126/211 |
| 5,357,943 | 10/1994 | Edgerton | 126/211 X |
| 5,377,660 | 1/1995 | Bombardier | 126/42 |

FOREIGN PATENT DOCUMENTS

| | | |
|---|---|---|
| 3722623 | 1/1989 | Germany . |
| 8801604 | 1/1990 | Netherlands . |
| 924944 | 5/1963 | United Kingdom . |

*Primary Examiner*—Larry Jones
*Attorney, Agent, or Firm*—Richard C. Litman

[57] ABSTRACT

A stove-mounted grease splatter guard made of a flexible plastic or glass protection portion which attaches to a range via a base portion. The protection portion extends outwardly from the range at an obtuse angle and prevents children from reaching a top surface of the stove. The protection portion also aids in preventing splattering grease from striking the children or reaching the floor on which the stove rests. The base portion is connected to the range with a magnet and hook-and-loop fastener combination.

10 Claims, 1 Drawing Sheet

GREASE SPLATTER GUARD

BACKGROUND OF THE INVENTION

1. Field of the Invention

The present invention relates generally to splash guards, and more particularly to splash guards for protecting against splashes of heated grease and other heated food.

2. Description of the Prior Art

Stove-top ranges are usually considered an essential implement in any kitchen. However, such ranges are also dangerous and messy. Not only can the stove-top itself burn curious children's hands, but hot grease from stove-top food can splatter or splash, causing burns and messes.

U.S. Pat. No. 2,778,356, issued to Paul I. Pugach, on Jan. 22, 1957, describes a guard for a cooking range. The guard slides out of a slide-way and pivots to form a perpendicular wall between a range and its surroundings. The wall does not extend from the range at an obtuse angle.

U.S. Pat. No. 3,513,826, issued to Charles F. Hellmuth, on May 26, 1970, describes a stove guard. The guard comprises a right-angled wall that totally surrounds a range, and includes an inner lip on the wall. This arrangement potentially increases the danger inherent in using a range, inasmuch as the lip could catch a handle of a pan, and the totally encompassing, right-angled wall would tend to obstruct a user's access to and control over pots and pans on the range.

U.S. Pat. No. 4,155,343, issued to Dorothy M. Hartman, on May 22, 1979, describes a safety device for a stove. The device has a hinged plate that pivots to overlie front burners of a range. The front burners cannot be used while the plate is overlying the front burners.

U.S. Pat. No. 4,157,705, issued to Michael N. Caan, on Jun. 12, 1979, describes a range guard. The guard is a U-shaped wall member that juts upward from an edge of a range at a ninety degree angle, preventing generous access of a user to a range guarded by the device of this patent. The wall does not extend from the range at an obtuse angle.

U.S. Pat. No. 4,517,955, issued to Conrad P. Ehrlich, et al., on May 21, 1985, describes a stove safety guard that attaches to a side or sides of a range via hinges and latches. The guard of this patent is relatively complicated and hence relatively expensive to manufacture.

U.S. Pat. No. 4,836,181, issued to Halvor Saga, on Jun. 6, 1989, describes a safety device for stoves. The device of this patent includes a complicated track operation in which a wall portion is raised relative to a range, with a ninety degree angle. The wall does not extend from the range at an obtuse angle.

U.S. Pat. No. 5,076,255, issued to Bradford L. Harrison, on Dec. 31, 1991, describes an appliance barrier that attaches to a range via C-clamp members, with a ninety degree angle. The wall does not extend from the range at an obtuse angle.

British Patent Document No. 924,944, issued to Ellen Louise Billet, on May 1, 1963, describes a safety guard for cooking appliances. The guard has an openable mesh screen that totally surrounds a range and extends at a ninety-degree angle from the range, thus tending to obstruct a user's access to and control over pots and pans on the range.

German Patent Document No. 3,722,623, issued to Alwin Neukamm, on Jan. 19, 1989, describes a splash protector for a range. The protector is disposed horizontally above the range, and is adjustable vertically. A region of the range covered by the protector, making that region inaccessible to a user of the range.

Netherlands Patent Document No. 8,801,604, issued to J. P. Vos, on Jan. 16, 1990, describes a range guard. The guard is a U-shaped wall member that juts upward from an edge of a range at ninety degree angle, preventing generous access of a user to a range guarded by the device of this patent. The wall does not extend from the range at an obtuse angle.

None of the above inventions and patents, taken either singly or in combination, is seen to describe the instant invention as claimed.

SUMMARY OF THE INVENTION

A stove-mounted grease splatter guard comprises a flexible splatter protection portion which attaches to a stove via a base portion. The protection portion extends outwardly from the stove with an obtuse angle and prevents children from reaching a top surface of the stove. The panel also aids in preventing splattering grease from striking the children or reaching a floor on which the stove rests.

Accordingly, it is a principal object of the invention to prevent children from touching a hot range-top.

It is another object of the invention to prevent grease and other hot food from spattering from a range-top.

It is a further object of the invention to avoid blockage of access to a range by a range guard.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

The present invention, a grease splatter guard, is a device for use with stove-top ranges, to aid in safety and cleanliness. The splatter guard is simple in design, leading to quick and inexpensive manufacture. The guard also avoids obstruction of the range for users of the range.

Figure 1:
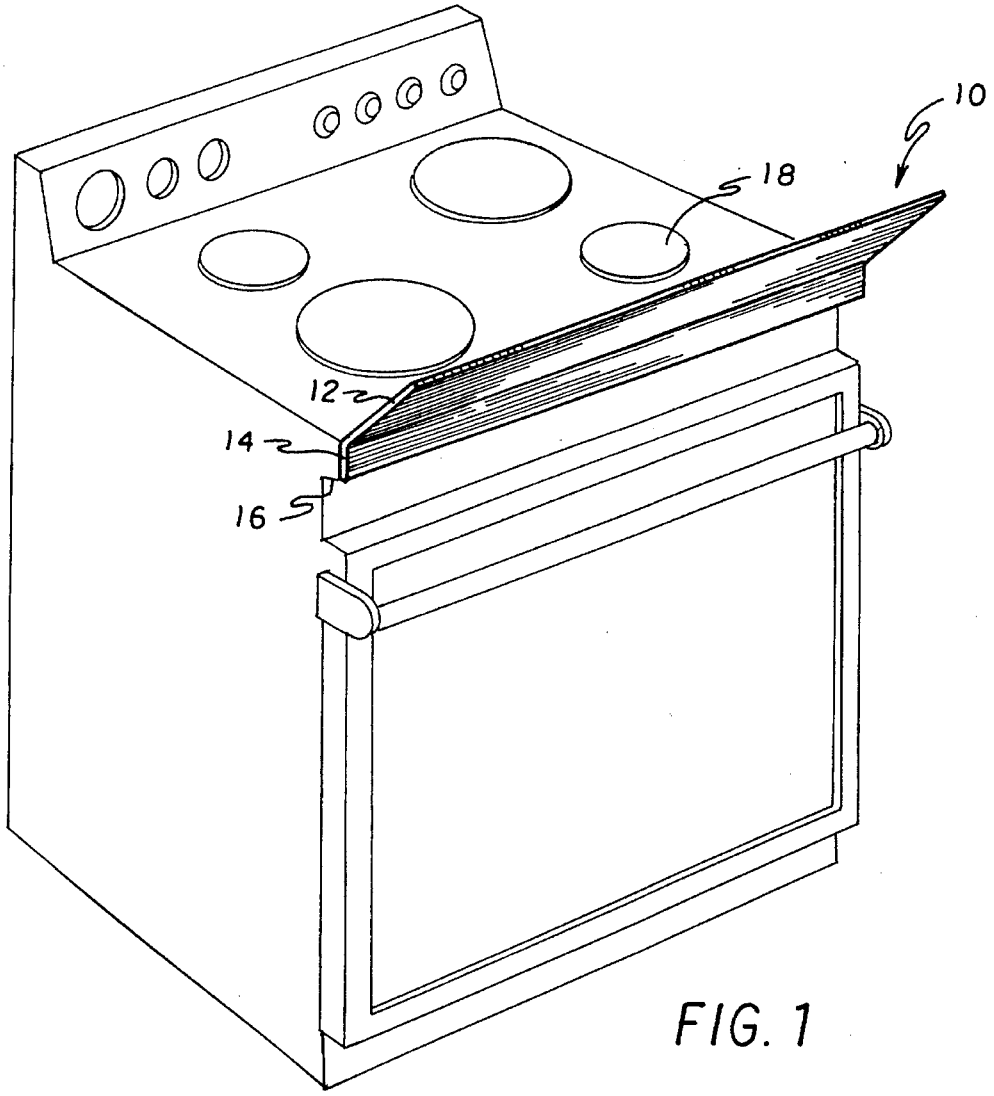
FIG. 1 is an environmental, perspective view of the present invention when attached to a range-top.

Referring to FIG. 1, the grease splatter guard 10 has a splatter protection portion 12 and a base portion 14. Both portions 12, 14 are flat and elongated, having extended, rectangular shapes. The portions 12, 14 can be constructed of any durable and flexible plastic material or a glass composition, although preferred materials include those that are strong heat insulators. Most preferably, the material is Lexan glass (TM), a polycarbonate resin which resists shattering and withstands temperatures up to one-hundred-eighty degrees Fahrenheit. The material can be of any of a variety of colors, such as gray and rust, or the material can be clear. This material also has the advantage of being lightweight for its strength.

Figure 2:
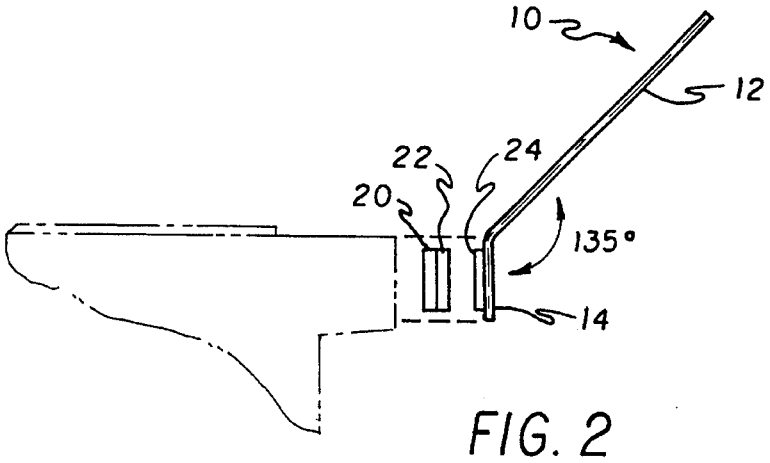
FIG. 2 is a side view showing the angle that a guard portion of the present invention makes in relation to a base portion of the present invention.

The splatter protection portion 12 and the base portion 14 are at an angle in the range between 120° to 135° between the two portions as depicted in FIG. 2. This angle constitutes a central aspect of the present invention, inasmuch as it allows clearance of pot handles over the protection portion 12 of the splatter guard 10, while still providing protection against burning and splattering. The base portion 14 of the splatter guard 10 has means for connecting the base portion to a front side 16 of a range-top 18. Preferably, this means for connecting is a thirty-inch by one-inch magnetic strip 20 of known type that adheres magnetically to the side 16 and adheres via hook-and-loop fasteners 22, 24 of known type, disposed on the magnetic strip 20 and the base portion 14, to substantially the entire length of the base portion 14. When this magnetic strip 20 and hook-and-loop fastener 22, 24 combination is used, the splatter guard 10 is much easier to remove than when conventional means for connecting objects are used. Alternately, the base portion 14 of the splatter guard 10 can be attached to the front side 16 of the range-top 18 via known means, such as adhesive, bolts, screws, guide tracks, and other known means.

The base portion 14 is connected in such a fashion as to angle away from the range-top 18, preferably so as to create a 135° angle with the vertical front topside of the range-top, if the range-top 18 forms a ninety degree angle, as shown in FIG. 2. Alternately, the base portion could be connected in other orientations, depending on the preferences of the user.

It is to be understood that the present invention is not limited to the sole embodiment described above, but encompasses any and all embodiments within the scope of the following claims.

We claim:

1. A grease splash guard, for a range-top comprising:

a flat, elongated splatter protection portion;

a flat, elongated base portion having an inside face and an outside face said base portion being at an angel to said splatter protection portion being in the range of 120° to 150°;

said inside face of said flat, elongated base portion removably attached to a vertical front topside of the range-top by an elongated magnetic strip attached to said base portion with elongated hook and loop fasteners disposed on said magnetic strip and said base portion, said magnetic strip extending along said vertical front topside of said range-top.

2. The grease splash guard according to claim 1, wherein said angle is 135°.

3. The grease splash guard according to claim 1, wherein said splatter protection portion angles away from the range-top when said base portion is removably attached to the range-top.

4. The grease splash guard according to claim 1, wherein said guard comprises a gray colored flexible plastic material.

5. The grease splash guard according to claim 1, wherein said guard comprises a rust colored flexible plastic material.

6. The grease splash guard according to claim 1, wherein said guard comprises a clear flexible plastic material.

7. The grease splash guard according to claim 1, wherein said guard comprises a polycarbonate resin material.

8. The grease splash guard according to claim 7, wherein said polycarbonate resin material is clear.

9. The grease splash guard according to claim 7, wherein said polycarbonate resin material is gray in color.

10. The grease splash guard according to claim 7, wherein said polycarbonate resin material is rust in color.

* * * * *